US012196114B2

(12) United States Patent
An et al.

(10) Patent No.: US 12,196,114 B2
(45) Date of Patent: Jan. 14, 2025

(54) META-MUFFLER FOR REDUCING BROADBAND NOISE

(71) Applicants: CENTER FOR ADVANCED META-MATERIALS, Daejeon (KR); AJOU UNIVERSITY INDUSTRY-ACADEMIC COOPERATION FOUNDATION, Suwon-si (KR)

(72) Inventors: Byung Hun An, Suwon-si (KR); Jin Woo Lee, Suwon-si (KR); Hak Joo Lee, Daejeon (KR)

(73) Assignees: CENTER FOR ADVANCED META-MATERIALS, Daejeon (KR); AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 116 days.

(21) Appl. No.: 18/105,899

(22) Filed: Feb. 6, 2023

(65) Prior Publication Data

US 2023/0184147 A1 Jun. 15, 2023

Related U.S. Application Data

(63) Continuation of application No. PCT/KR2021/014162, filed on Oct. 14, 2021.

(30) Foreign Application Priority Data

Oct. 28, 2020 (KR) ..... 10-2020-0141469

(51) Int. Cl.
*F01N 1/02* (2006.01)

(52) U.S. Cl.
CPC ..... *F01N 1/023* (2013.01); *F01N 2490/08* (2013.01); *F01N 2490/155* (2013.01)

(58) Field of Classification Search
CPC ..... F01N 1/023; F01N 1/026; F01N 2490/15
See application file for complete search history.

(56) References Cited

U.S. PATENT DOCUMENTS 3,754,619 A * 8/1973 McCormick ..... F01N 1/04 422/607
4,055,231 A * 10/1977 Martinez ..... F01N 1/22 181/282

(Continued)

FOREIGN PATENT DOCUMENTS

CN 106205591 A 12/2016
JP 11-022444 A 1/1999

(Continued)

OTHER PUBLICATIONS

International Search Report of PCT/KR2021/014162 mailed Jan. 10, 2022.

*Primary Examiner* — Jeremy A Luks
(74) *Attorney, Agent, or Firm* — Revolution IP, PLLC

(57) ABSTRACT

Disclosed herein is a meta-muffler for reducing broadband noise. The meta-muffler includes: a flow pipe through which a fluid flows; an outer barrel disposed outside the flow pipe to be spaced apart from the flow pipe; and multiple meta-structures arranged in a flow direction of the fluid and each comprising an opening opened parallel to the flow direction of the fluid, a resonance chamber disposed between the flow pipe and the outer barrel and communicating with the flow pipe through the opening, and a neck adjustment member extending from the outer barrel toward the flow pipe to be spaced apart from the opening in the flow direction of the fluid. The meta-muffler can increase transmission loss of noise flowing through the flow pipe through maximization (Continued)

of energy loss of sound waves entering the resonance chamber of the metastructure and can effectively attenuate noise over a wide band ranging from low frequencies to high frequencies.

8 Claims, 7 Drawing Sheets

(56) References Cited

U.S. PATENT DOCUMENTS 5,502,283 A * 3/1996 Ukai ..... F01N 1/06 181/251
5,783,780 A * 7/1998 Watanabe ..... F02M 35/1261 181/252
5,952,625 A * 9/1999 Huff ..... F01N 1/06 181/266
6,508,331 B1 * 1/2003 Stuart ..... F02M 35/1266 123/184.57
6,595,319 B1 * 7/2003 Huff ..... F01N 13/20 181/250
7,942,239 B2 * 5/2011 Huff ..... F01N 1/02 181/266
8,800,713 B2 * 8/2014 Keesser ..... F01N 1/082 181/266
10,403,256 B2 * 9/2019 Denker ..... F02M 35/1266
2008/0066999 A1 * 3/2008 Kostun ..... F02M 35/1222 181/250
2015/0345497 A1 12/2015 Lucas et al.

FOREIGN PATENT DOCUMENTS

KR 10-2004-0018720 A 3/2004
KR 10-2004-0097531 A 11/2004
WO WO-2007101412 A1 * 9/2007 ..... F01N 1/003

* cited by examiner

【FIG. 1】
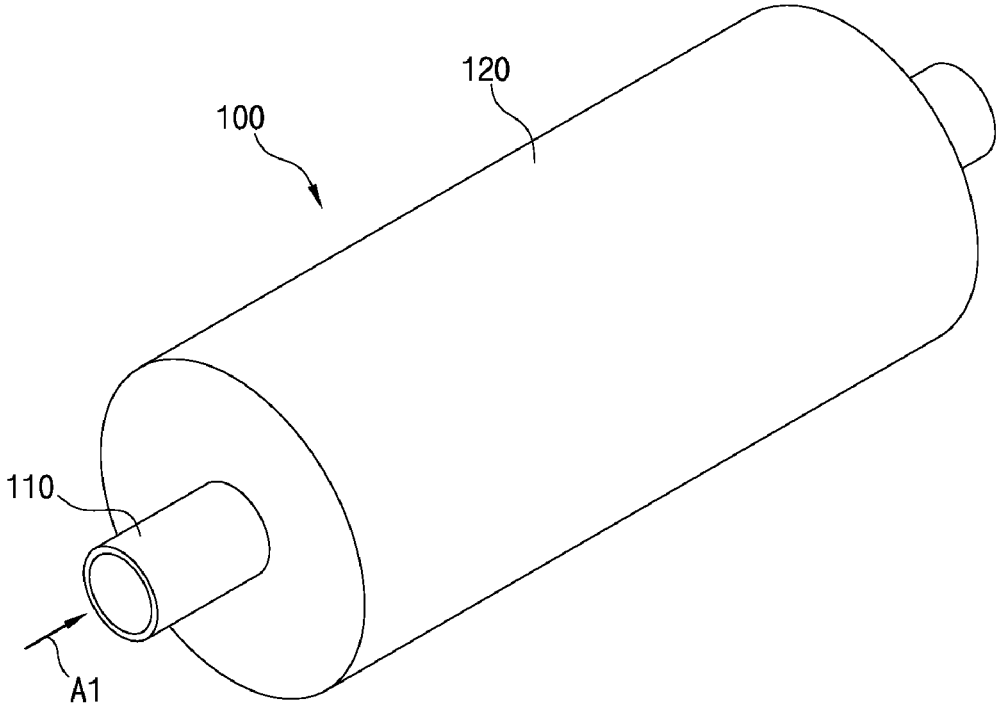

【FIG. 2】
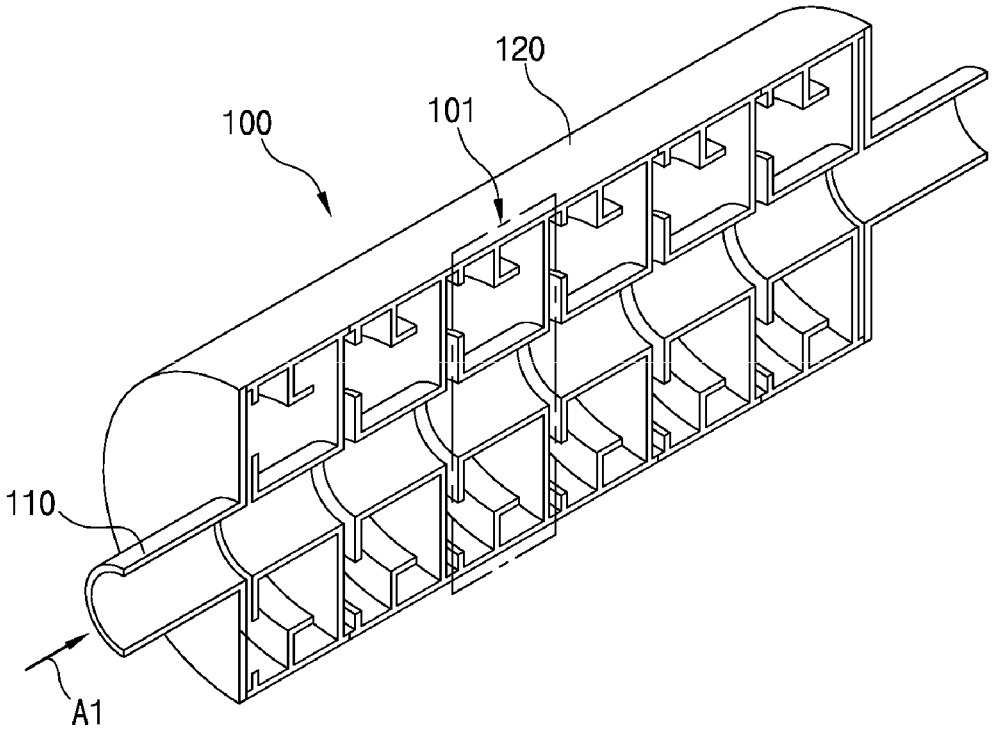

【FIG. 3】
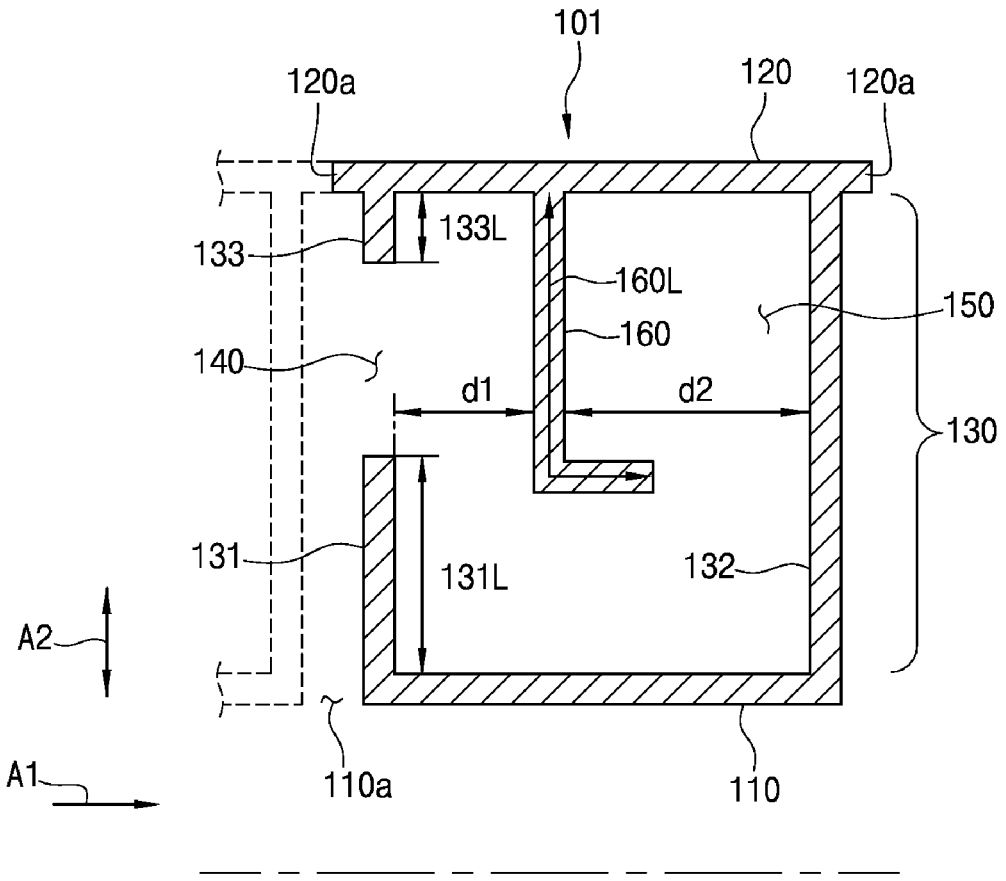

【FIG. 4】
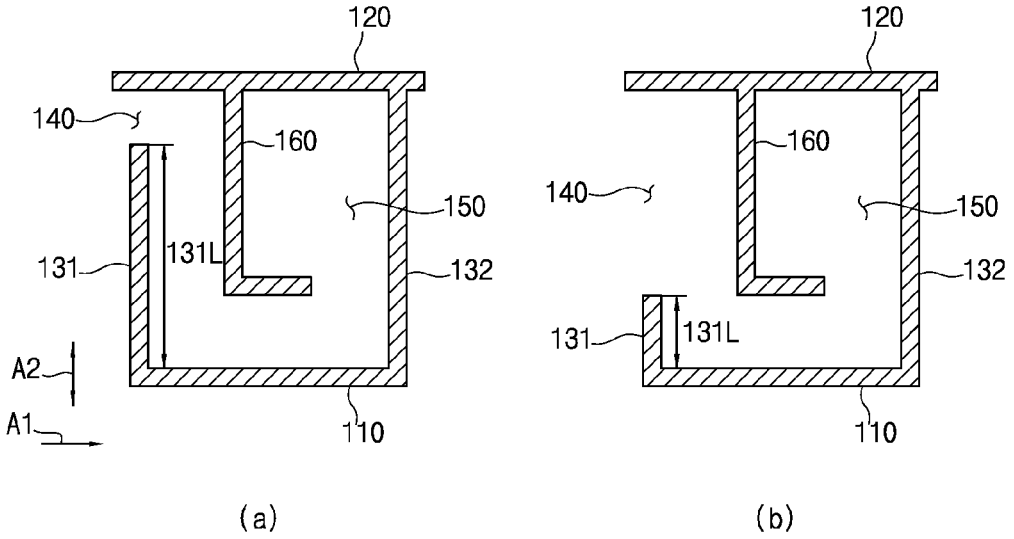
【FIG. 5】
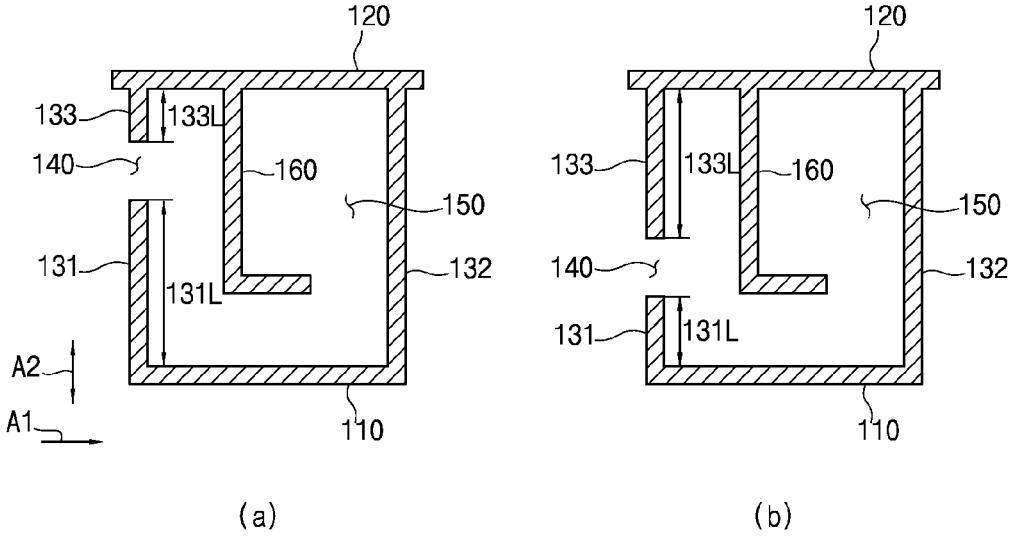

【FIG. 6】
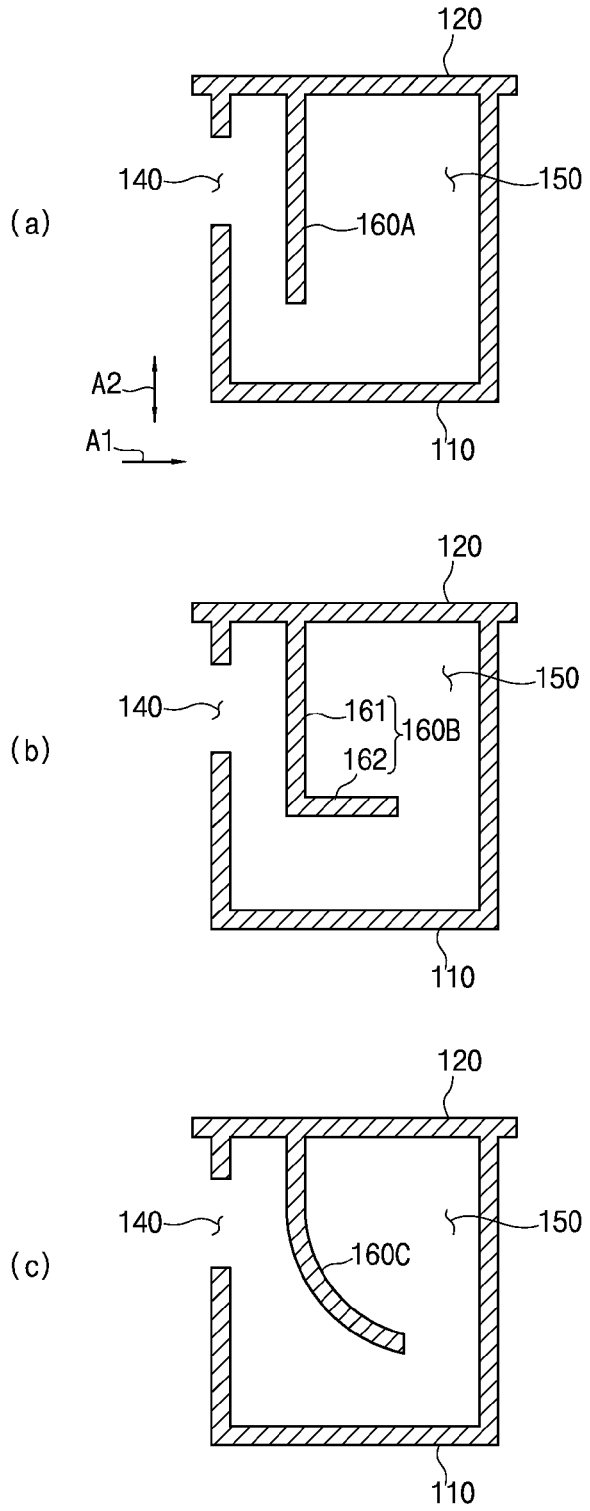

【FIG. 7】
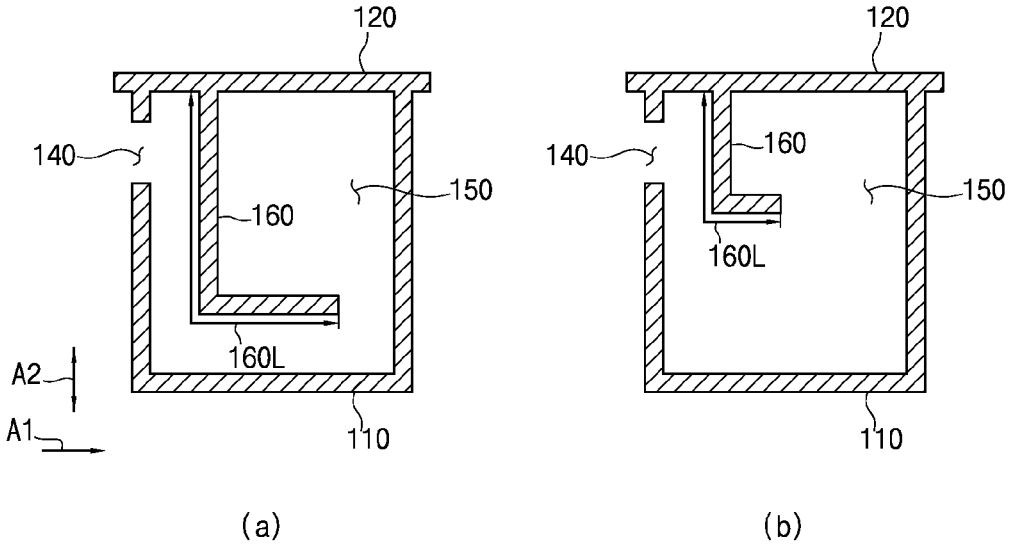
【FIG. 8】
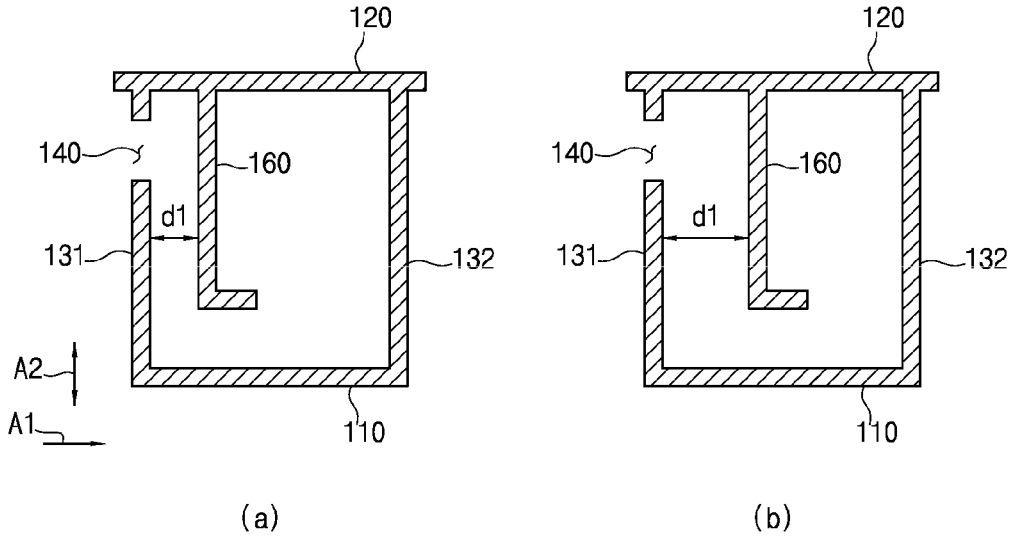

【FIG. 9】
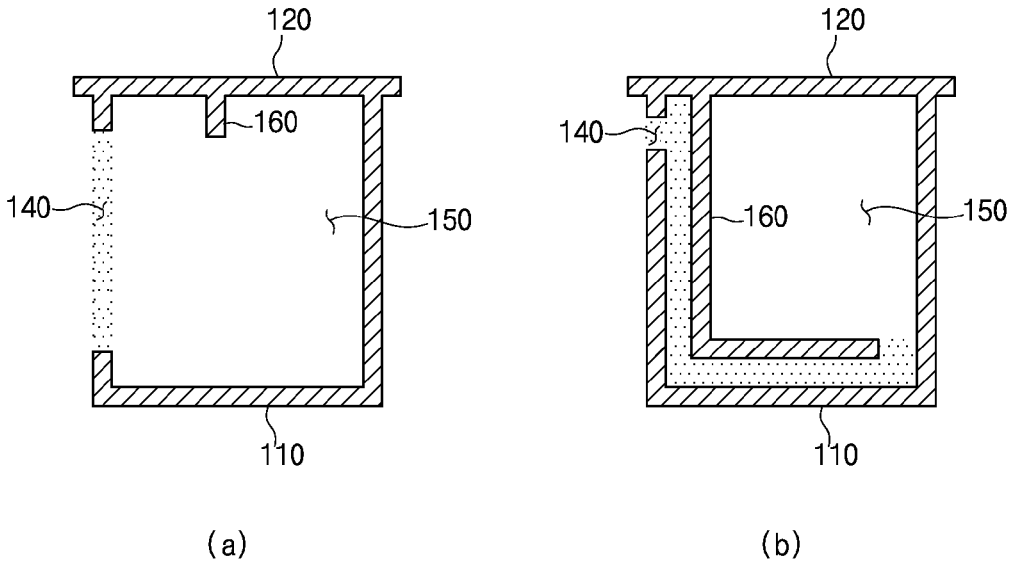

META-MUFFLER FOR REDUCING BROADBAND NOISE

TECHNICAL FIELD

The present invention relates to a muffler and, more particularly, to a meta-muffler for reducing broadband noise, which can increase transmission loss of noise flowing through a flow pipe using a metastructure disposed outside the flow pipe.

BACKGROUND ART

Various noise reduction devices have been developed and put into use. Thereamong, an absorption type noise reduction device using a sound-absorbing material has good performance in reducing high frequency noise. However, such a sound absorption type noise reduction device has problems of poor performance in reducing low frequency noise, dust emission from the sound-absorbing material, and poor durability due to vulnerability to moisture or heat stress.

Recently, besides the absorption type noise reduction device, a reflective noise reduction device has been widely used. Such a reflective noise reduction device reduces noise through reflection of sound waves using impedance mismatch caused by changes in geometric shape of a flow pipe. Examples of the reflective noise reduction device include models using an expansion pipe or a perforation pipe adapted to change the cross-sectional area of a pipe. However, since noise reduction performance of such models is directly related to the degree of change in cross-sectional area of the pipe, there is a problem of increase in device size or volume.

In a resonator-based noise reduction device, a resonator having a frequency that matches the frequency of noise generated in a flow pipe is installed on the flow pipe to reduce the noise. However, since the size of the resonator needs to be within a certain limit due to several design considerations such as a positional relationship between different pipes and a relationship with surrounding structures, the resonator-based noise reduction device has poor performance in reducing noise outside a target frequency range.

In general, removal of high frequency noise requires a resonator having a relatively small size, whereas removal of high frequency noise requires a resonator having a relatively large size. However, since a flow pipe is generally installed in a narrow space, it is not easy to install a large-sized resonator, making it difficult to remove low frequency noise using the resonator-based noise reduction device. In addition, use of a large-sized resonator is far from a recent trend of pursuing reduction in device size.

DISCLOSURE

Technical Problem

Embodiments of the present invention are conceived to solve such problems in the art and provide a meta-muffler which can increase transmission loss of noise flowing through a flow pipe through maximization of energy loss of sound waves entering a resonance chamber of a metastructure and can effectively attenuate noise over a wide band ranging from low frequencies to high frequencies.

Technical Solution

In accordance with one aspect of the present invention, a meta-muffler for reducing broadband noise includes: a flow pipe through which a fluid flows; an outer barrel disposed outside the flow pipe to be spaced apart from the flow pipe; and multiple metastructures arranged in a flow direction of the fluid and each including an opening opened parallel to the flow direction of the fluid, a resonance chamber disposed between the flow pipe and the outer barrel and communicating with the flow pipe through the opening, and a neck adjustment member extending from the outer barrel toward the flow pipe to be spaced apart from the opening in the flow direction of the fluid.

An outer wall of the resonance chamber may include a first outer wall extending from the flow pipe in a direction crossing the flow direction of the fluid and a second outer wall extending from the flow pipe to the outer barrel to be spaced apart from the first outer wall in the flow direction of the fluid, and the opening may be formed between the first outer wall and the outer barrel.

When noise to be attenuated has a relatively low frequency, the first outer wall may have a relatively large length and, when noise to be attenuated has a relatively high frequency, the first outer wall may have a relatively small length.

The outer wall of the resonance chamber may further include a third outer wall extending from the outer barrel in the direction crossing the flow direction of the fluid and the opening may be formed between the first outer wall and the third outer wall.

The neck adjustment member may have a shape of a straight line perpendicular to the flow direction of the fluid.

The neck adjustment member may include a first bar extending from the outer barrel in a direction crossing the flow direction of the fluid and a second bar extending from an end of the first bar in the flow direction of the fluid.

Each of the first bar and the second bar may have a straight line shape.

The neck adjustment member may extend from the outer barrel toward the flow pipe and may have a predetermined curvature to be curved in the flow direction of the fluid toward an end of the neck adjustment member.

When noise to be attenuated has a relatively low frequency, the neck adjustment member may have a relatively large length and when noise to be attenuated has a relatively high frequency, the neck adjustment member may have a relatively small length.

An outer wall of the resonance chamber may include a first outer wall extending from the flow pipe in a direction crossing the flow direction of the fluid and a second outer wall extending from the flow pipe to the outer barrel to be spaced apart from the first outer wall in the flow direction of the fluid, and the neck adjustment member may be spaced apart from the first outer wall by a first distance in the flow direction of the fluid and may be spaced apart from the second outer wall by a second distance in the flow direction of the fluid, wherein the first distance may be shorter than the second distance.

An outer wall of the resonance chamber may include a first outer wall extending from the flow pipe in a direction crossing the flow direction of the fluid and a second outer wall extending from the flow pipe to the outer barrel to be spaced apart from the first outer wall in the flow direction of the fluid, and the neck adjustment member may be spaced apart from the first outer wall by a first distance in the flow direction of the fluid, wherein, when noise to be attenuated has a relatively low frequency, the first distance may be relatively short and when noise to be attenuated has a relatively high frequency, the first distance may be relatively long.

Advantageous Effects

According to the present invention, the meta-muffler for reducing broadband noise can increase transmission loss of noise flowing in a flow pipe using a metastructure including an opening, a resonance chamber, and a neck adjustment member.

According to the present invention, the meta-muffler for reducing broadband noise can broaden an attenuation target noise frequency band using the metastructure including the opening, the resonance chamber, and the neck adjustment member.

According to the present invention, despite a limited volume of the resonance chamber, the meta-muffler for reducing broadband noise can attenuate noise in a target frequency band simply by appropriately changing the design of the metastructure, thereby allowing reduction in size of the muffler and making it easy to change the design of the muffler having a limited size.

DESCRIPTION OF DRAWINGS

FIG. 1 is a view of a meta-muffler according to one embodiment of the present invention.

FIG. 2 is a sectional view of the meta-muffler of FIG. 1.

FIG. 3 is a partially enlarged sectional view of the meta-muffler of FIG. 1.

FIG. 4 is a view illustrating adjustment of the area of an opening according to one embodiment of the present invention.

FIG. 5 is a view illustrating adjustment of the position of the opening according to one embodiment of the present invention.

FIG. 6 is a view illustrating various shapes of a neck adjustment member according to embodiments of the present invention.

FIG. 7 is a view illustrating adjustment of the length of the neck adjustment member according to one embodiment of the present invention.

FIG. 8 is a view illustrating adjustment of the position of the neck adjustment member according to one embodiment of the present invention.

FIG. 9 shows a metastructure (a) suitable for attenuation of noise in a relatively high frequency band and a metastructure (b) suitable for attenuation of noise in a relatively low frequency band according to embodiments of the present invention.

MODE FOR INVENTION

Hereinafter, preferred embodiments of the present invention will be described with reference to the accompanying drawings. In description of the embodiments, the same components will be denoted by the same terms and the same reference numerals and redundant description thereof will be omitted.

FIG. 1 is a view of a meta-muffler according to one embodiment of the present invention, FIG. 2 is a sectional view of the meta-muffler of FIG. 1, and FIG. 3 is a partially enlarged sectional view of the meta-muffler of FIG. 1.

Referring to FIG. 1 to FIG. 3, the meta-muffler 100 according to this embodiment is provided to increase transmission loss of noise through maximization of energy loss of sound waves flowing through a flow pipe 110, and may include a flow pipe 110, an outer barrel 120, and a metastructure 130.

The meta-muffler 100 according to this embodiment may include multiple unit cells 101, and each of the unit cells 101 may include a flow pipe 110, an outer barrel 120, and a metastructure 130. That is, the multiple unit cells 101 each including the flow pipe 110, the outer barrel 120, and the metastructure 130 may be sequentially arranged in a flow direction A1 of a fluid (hereinafter referred to as a "flow direction) to form the meta-muffler 100. Accordingly, multiple metastructures 130 may be sequentially arranged in the flow direction A1.

The flow pipe 110, the outer barrel 120, and the metastructure 130 constituting the unit cell 101 may be integrally formed with one another. Alternatively, the flow pipe 110, the outer barrel 120, and the metastructure 130 may be separately fabricated and assembled into the unit cell 101.

The multiple unit cells 101 constituting the meta-muffler 100 may be integrally formed with one another. Alternatively, the multiple unit cells 101 may be separately fabricated and assembled into the meta-muffler 100.

Next, the flow pipe 110, the outer barrel 120, and the metastructure 130 constituting the unit cell 101 will be described in detail.

The flow pipe 110 is a pipe through which a fluid flows and may extend in the flow direction A1.

The fluid flowing through the flow pipe 110 may be a liquid or a gas. In this embodiment, it is assumed that the fluid is air, which is a gas.

The multiple unit cells 101 may be disposed adjacent to one another in the flow direction A1, such that multiple flow pipes 110 are connected to one another in the flow direction A1 to form a main flow path through which the fluid flows. Accordingly, a portion of the fluid flowing through the main flow path may be introduced into the metastructure 130 through a fluid inlet 110*a* formed between a pair of adjacent flow pipes 110.

Although the flow pipe 110 is shown as having a circular cross-sectional shape in this embodiment, it should be understood that the present invention is not limited thereto and the flow pipe 110 may have a polygonal cross-sectional shape, such as a rectangular cross-sectional shape.

The outer barrel 120 is disposed outside the flow pipe 110 with a space therebetween to surround the flow pipe 110. The metastructure 130 may be disposed between the flow pipe 110 and the outer barrel 120.

The outer barrel 120 may include an extension 120*a* formed at a front or rear end thereof in the flow direction A1. When the multiple unit cells 101 are arranged adjacent to one another in the flow direction A1, the extension 120*a* allows a fluid inlet 110*a* to be formed between a pair of adjacent flow pipes 110.

The outer barrel 120 defines an outer shape of the meta-muffler 100 and may correspond in shape to the flow pipe 110. Although the outer barrel 120 is shown as having a circular cross-section corresponding to the cross-sectional shape of the flow pipe 110 in this embodiment, the outer barrel 120 may have a polygonal cross-sectional shape, such as a rectangular cross-sectional shape. It should be understood that the flow pipe 110 and the outer barrel 120 may have different cross-sectional shapes.

The metastructure 130 is disposed between the flow pipe 110 and the outer barrel 120 and may include an opening 140, a resonance chamber 150, and a neck adjustment member 160.

The opening 140 may be formed at a front end of the metastructure 130 in the flow direction A1 and may be opened parallel to the flow direction A1. The opening 140 may communicate with the fluid inlet 110*a* of the flow pipe 110.

The resonance chamber 150 may be disposed between the flow pipe 110 and the outer barrel 120 and may communicate with the fluid inlet 110*a* of the flow pipe 110 via the opening 140.

An outer wall of the resonance chamber 150 may include a first outer wall 131 and a second outer wall 132.

That is, the outer barrel 120 and the flow pipe 110 form a pair of lateral outer walls of the resonance chamber 150, respectively, and the first outer wall 131 and the second outer wall 132 form front and rear walls of the resonance chamber 150, respectively.

The first outer wall 131 may extend from the flow pipe 110 toward the outer barrel 120 in a direction A2 crossing the flow direction A1 (hereinafter referred to as a "crossing direction"). The first outer wall 131 may vertically extend toward the outer barrel 120.

The first outer wall 131 may have a predetermined length 131L, wherein the length 131L of the first outer wall 131 may be adjusted depending on an attenuation target noise frequency.

The second outer wall 132 may vertically extend from the flow pipe 110 to the outer barrel 120 to be spaced apart from the first outer wall 131 in the flow direction A1 while connecting the flow pipe 110 to the outer barrel 120.

Here, the opening 140 may be formed between the first outer wall 131 and the outer barrel 120. Accordingly, an area of the opening 140 may be adjusted by adjusting the length 131L of the first outer wall 131.

The outer wall of the resonance chamber 150 may further include a third outer wall 133.

That is, the outer barrel 120 and the flow pipe 110 form lateral outer walls of the resonance chamber 150, respectively, the first outer wall 131 and the third outer wall 133 form a front wall of the resonance chamber 150, and the second outer wall 132 forms a rear wall of the resonance chamber 150.

The third outer wall 133 may extend from the outer barrel 120 toward the flow pipe 110 in the crossing direction A2 and may extend vertically toward the flow pipe 110.

The third outer wall 133 may have a predetermined length 133L, wherein the length 133L of the third outer wall 133 may be adjusted depending on an attenuation target noise frequency.

Here, the opening 140 may be formed between the first outer wall 131 and the third outer wall 133. Accordingly, an area of the opening 140 may be adjusted by adjusting the length 131L of the first outer wall 131 or the length 133L of the third outer wall 133.

The neck adjustment member 160 may be disposed inside the resonance chamber 150 and may extend from the outer barrel 120 toward the flow pipe 110 to be spaced apart from the opening 140 in the flow direction A1.

The neck adjustment member 160 may have a predetermined length 160L, wherein the length 160L of the neck adjustment member 160 may be adjusted depending on an attenuation target noise frequency.

The neck adjustment member 160 may be spaced apart from the first outer wall 131 by a first distance d1 in the flow direction A1 and may be spaced apart from the second outer wall 132 by a second distance d2 in the flow direction A1.

Here, the first distance d1 may be shorter than the second distance d2. That is, with the neck adjustment member 160 disposed relatively close to the first outer wall 131, the metastructure 130 may have a region corresponding to a neck (orifice) of a Helmholtz resonator.

As such, the metastructure 130 according to the present invention may effectively attenuate noise at relatively low frequencies at the opening 140 parallel to the flow direction A1 due to so-called tubular resonance effects and may effectively attenuate noise at relatively high frequencies inside the resonance chamber 150 due to so-called Helmholtz resonance effects. Accordingly, it is possible to broaden an attenuation target noise frequency band.

In addition, by adjusting the length of the first outer wall 131 or the third outer wall 133, which determines the area of the opening 140, or by appropriately changing the length, shape, or position of the neck adjustment member 160, it is possible to further broaden an attenuation target noise frequency band.

FIG. 4 is a view illustrating adjustment of the area of the opening according to one embodiment of the present invention.

According to this embodiment, the area of the opening 140 may be adjusted by adjusting the first length 131L of the first outer wall 131.

Referring to FIG. 4(*a*), when an attenuation target noise frequency is relatively low, the length 131L of the first outer wall 131 is set to a relatively large value such that the opening 140 has a relatively small area. This may correspond to decreasing the width of the neck (orifice) of the Helmholtz resonator, thus allowing effective attenuation of noise in a relatively low frequency band.

Referring to FIG. 4(*b*), when an attenuation target noise frequency is relatively high, the length 131L of the first outer wall 131 is set to a relatively small value such that the opening 140 has a relatively large area. This may correspond to increasing the width of the neck (orifice) of the Helmholtz resonator, thus allowing effective attenuation of noise in a relatively high frequency band.

When the resonance chamber 150 includes the third outer wall 133 as shown in FIG. 3, the length 133L of the third outer wall 133 may be set to a relatively large value or a relatively small value depending on an attenuation target noise frequency such that the opening 140 has a relatively small area or a relatively large area.

FIG. 5 is a view illustrating adjustment of the position of the opening according to one embodiment of the present invention.

According to this embodiment, the position of the opening 140 in the crossing direction A2 may be adjusted by adjusting the length 131L of the first outer wall 131 and the length 133L of the third outer wall 133.

Referring to FIG. 5(*a*), when an attenuation target noise frequency is relatively low, the lengths of the first outer wall 131 and the third outer wall 133 may be adjusted such that the opening 140 is located at a relatively long distance from the flow pipe 110 in the crossing direction A2. This may correspond to increasing the length of the neck (orifice) of the Helmholtz resonator, thus allowing effective attenuation of noise in a relatively low frequency band.

Referring to FIG. 5(*b*), when an attenuation target noise frequency is relatively high, the lengths of the first outer wall 131 and the third outer wall 133 may be adjusted such that the opening 140 is located at a relatively short distance from the flow pipe 110 in the crossing direction A2. This may correspond to decreasing the length of the neck (orifice) of the Helmholtz resonator, thus allowing effective attenuation of noise in a relatively high frequency band.

FIG. 6 is a view illustrating various shapes of the neck adjustment member according to embodiments of the present invention.

The neck adjustment member 160 may be formed in various shapes depending on an attenuation target noise frequency. For example, the neck adjustment member 160 may have a straight line shape, a bent shape, a curved shape, or the like.

Referring to FIG. 6(*a*), a neck adjustment member 160A may have a straight line shape. That is, the neck adjustment member 160A may extend from the outer barrel 120 toward the flow pipe 110 in the form of a straight line perpendicular to the flow direction A1.

Referring to FIG. 6(*b*), a neck adjustment member 160B may have a bent shape. That is, the neck adjustment member 160B may include a first bar 161 extending from the outer barrel 120 in the crossing direction A2 and a second bar 162 extending from an end of the first bar 161 in the flow direction A1, wherein each of the first bar 161 and the second bar 162 may have a straight line shape.

Referring to FIG. 6(*c*), a neck adjustment member 160C may have a curved shape. That is, the neck adjustment member 160C may extend from the outer barrel 120 toward the flow pipe 110 in the form of a curve that is curved in the flow direction A1 toward an end thereof while generally having a certain curvature. Here, the curvature of the neck adjustment member 160C may be varied depending on an attenuation target noise frequency.

When an attenuation target noise frequency is determined, the shape of the neck adjustment member 160 may be determined to correspond to the target noise frequency. By appropriately changing the shape of the neck adjustment member 160, it is possible to broaden an attenuation target noise frequency band.

FIG. 7 is a view illustrating adjustment of the length of the neck adjustment member according to one embodiment of the present invention.

According to this embodiment, it is possible to broaden an attenuation target noise frequency band by changing the overall length L of the neck adjustment member 160.

Referring to FIG. 7(*a*), when an attenuation target noise frequency is relatively low, the length 160L of the neck adjustment member 160 may be set to a relatively large value. This may correspond to increasing the length of the neck (orifice) of the Helmholtz resonator, thus allowing effective attenuation of noise in a relatively low frequency band.

Referring to FIG. 7(*b*), when an attenuation target noise frequency is relatively high, the length 160L of the neck adjustment member 160 may be set to a relatively small value. This may correspond to decreasing the length of the neck (orifice) of the Helmholtz resonator, thus allowing effective attenuation of noise in a relatively high frequency band.

FIG. 8 is a view illustrating adjustment of the position of the neck adjustment member according to one embodiment of the present invention.

According to this embodiment, it is possible to broaden an attenuation target noise frequency band through adjustment of the position of the neck adjustment member 160 in the resonance chamber 150, besides adjustment of the shape and length of the neck adjustment member 160 as described above.

Referring to FIG. 8(*a*), when an attenuation target noise frequency is relatively low, the first distance d1 between the neck adjustment member 160 and the first outer wall 131 may be set relatively short. This may correspond to increasing the length of the neck (orifice) of the Helmholtz resonator while allowing maximum utilization of a limited volume of the resonance chamber 150, thus allowing effective attenuation of noise in a relatively low frequency band.

Referring to FIG. 8(*a*), when an attenuation target noise frequency is relatively high, the first distance d1 between the neck adjustment member 160 and the first outer wall 131 may be set relatively long. This may correspond to decreasing the length of the neck (orifice) of the Helmholtz resonator, thus allowing effective attenuation of noise in a relatively high frequency band.

FIG. 9 shows a metastructure (a) suitable for attenuation of noise in a relatively high frequency band and a metastructure (b) suitable for attenuation of noise in a relatively low frequency band according to embodiments of the present invention.

In the metastructure of FIG. 9(*a*), each of the first outer wall 131, the third outer wall 133, and the neck adjustment member 160 has a relatively small length and the neck adjustment member 160 is located at a relatively long distance from the first outer wall 131. That is, the neck adjustment member 160 has a relatively small size and the opening 140 has a relatively large area.

According to the principle of the Helmholtz resonator, this embodiment corresponds to relatively increasing the width of the neck (orifice) of the Helmholtz resonator while relatively decreasing the length of the neck (orifice) of the Helmholtz resonator in a given limited volume of the resonance chamber 150, thereby allowing generation of a relatively high resonant frequency and thus allowing effective attenuation of noise in a relatively high frequency band.

In the metastructure of FIG. 9(*b*), each of the first outer wall 131, the third outer wall 133, and the neck adjustment member 160 has a relatively large length and the neck adjustment member 160 is located at a relatively short distance from the first outer wall 131. That is, the neck adjustment member 160 has a relatively large size and the opening 140 has a relatively small area.

According to the principle of the Helmholtz resonator, this embodiment corresponds to relatively decreasing the width of the neck (orifice) of the Helmholtz resonator while relatively increasing the length of the neck (orifice) of the Helmholtz resonator in a given limited volume of the resonance chamber 150, thereby allowing generation of a relatively low resonant frequency and thus allowing effective attenuation of noise in a relatively low frequency band.

According to the present invention, it is possible to effectively generate a resonant frequency corresponding to an attenuation target noise frequency through appropriate adjustment of the length 131L of the first outer wall 131, the length 133L of the third outer wall 133, and the length 160L, shape, or position of the neck adjustment member 160, thereby allowing effectively attenuation of broadband noise.

In addition, according to the present invention, it is possible to attenuate noise in a target frequency band by simply adjusting the length 131L of the first outer wall 131, the length 133L of the third outer wall 133, and the length 160L, shape, or position of the neck adjustment member 160, thereby allowing reduction in size of the muffler.

Although exemplary embodiments have been described herein, it should be understood that these embodiments are provided for illustration only and are not to be construed in any way as limiting the present invention, and that various modifications, changes, or alterations can be made by those skilled in the art without departing from the spirit and scope of the invention.

INDUSTRIAL APPLICABILITY

The present invention is industrially applicable to the field of meta-muffler technology for broadband noise reduction that can increase transmission loss of noise flowing through a flow pipe using a metastructure disposed outside the flow pipe.

The invention claimed is:

1. A meta-muffler for reducing broadband noise, comprising:

a flow pipe through which a fluid flows;

an outer barrel disposed outside the flow pipe to be spaced apart from the flow pipe; and multiple metastructures arranged in a flow direction of the fluid and each comprising an opening opened parallel to the flow direction of the fluid, a resonance chamber disposed between the flow pipe and the outer barrel and communicating with the flow pipe through the opening, and a neck adjustment member extending from the outer barrel toward the flow pipe to be spaced apart from the opening in the flow direction of the fluid, wherein the neck adjustment member comprises a first bar extending from the outer barrel in a direction crossing the flow direction of the fluid and a second bar extending from an end of the first bar in the flow direction of the fluid, wherein each of the first bar and the second bar has a straight line shape.

2. The meta-muffler according to claim 1, wherein an outer wall of the resonance chamber comprises a first outer wall extending from the flow pipe in a direction crossing the flow direction of the fluid and a second outer wall extending from the flow pipe to the outer barrel to be spaced apart from the first outer wall in the flow direction of the fluid, and the opening is formed between the first outer wall and the outer barrel.

3. The meta-muffler according to claim 2, wherein a length of the first outer wall is adjustable based on a frequency of noise to be attenuated, such that the length of the first outer wall is inversely proportional to the frequency of noise to be attenuated.

4. The meta-muffler according to claim 2, wherein the outer wall of the resonance chamber further comprises a third outer wall extending from the outer barrel in the direction crossing the flow direction of the fluid, and the opening is formed between the first outer wall and the third outer wall.

5. The meta-muffler according to claim 1, wherein the neck adjustment member has a shape of a straight line perpendicular to the flow direction of the fluid.

6. The meta-muffler according to claim 1, wherein a length of the neck adjustment member is adjustable based on a frequency of noise to be attenuated, such that the length of the neck adjustment member is inversely proportional to the frequency of noise to be attenuated.

7. The meta-muffler according to claim 1, wherein:

an outer wall of the resonance chamber comprises a first outer wall extending from the flow pipe in a direction crossing the flow direction of the fluid and a second outer wall extending from the flow pipe to the outer barrel to be spaced apart from the first outer wall in the flow direction of the fluid; and the neck adjustment member is spaced apart from the first outer wall by a first distance in the flow direction of the fluid and is spaced apart from the second outer wall by a second distance in the flow direction of the fluid, the first distance being shorter than the second distance.

8. The meta-muffler according to claim 1, wherein:

an outer wall of the resonance chamber comprises a first outer wall extending from the flow pipe in a direction crossing the flow direction of the fluid and a second outer wall extending from the flow pipe to the outer barrel to be spaced apart from the first outer wall in the flow direction of the fluid;

the neck adjustment member is spaced apart from the first outer wall by a first distance in the flow direction of the fluid; and, the first distance is adjustable based on a frequency of noise to be attenuated, such that the first distance is directly proportional to the frequency of noise to be attenuated.

* * * * *